5/19/81 OR 4,267,726

United States Patent [19]

Noïk

[11] 4,267,726

[45] May 19, 1981

[54] WELL PRESSURE TESTING METHOD

[75] Inventor: Simon P. Noïk, Verrières le Buisson, France

[73] Assignee: Schlumberger Technology Corporation, Houston, Tex.

[21] Appl. No.: 69,220

[22] Filed: Aug. 23, 1979

[30] Foreign Application Priority Data

Aug. 30, 1978 [FR] France ..... 78 24998

[51] Int. Cl.[3] ..... E21B 47/06

[52] U.S. Cl. ..... 73/151

[58] Field of Search ..... 73/155, 714, 151

[56] References Cited

U.S. PATENT DOCUMENTS

| | | | |
|---|---|---|---|
| Re. 21,383 | 3/1940 | Walker | 73/155 |
| 2,348,192 | 5/1944 | Chambers | 73/155 |
| 3,184,965 | 5/1965 | Noik | 73/152 |
| 3,283,570 | 11/1966 | Hodges | 73/155 |
| 3,321,965 | 5/1967 | Johnson et al. | 73/155 |
| 3,905,226 | 9/1975 | Nicolas | 73/155 |
| 3,909,603 | 9/1975 | Nicolas | 235/151.34 |

*Primary Examiner*—Jerry W. Myracle

[57] ABSTRACT

A method for testing producing oil and gas wells is disclosed for determining a representation of pressure at different selected levels of an interval having one or more production zones by combining pressure and pressure gradient measurements. Another aspect of the invention enables the determination of production level performance by combining flow measurements and pressure gradient measurements to create pressure versus flow curves for each production level of an interval.

9 Claims, 8 Drawing Figures

X(DEPTH)
X(DEPTH)
22
23
B
C
D
ΔP
(PRESSURE
GRADIANT)
PRESSURE
P=∫ΔPdx

X(DEPTH)
B
Ps
C
D
Pi
24
P (PRESSURE)

D
C
B
A
Pi
Ps
Mi
Ms
29
28
33
35
34
27
32
0
Qi
Qs
P (PRESSURE, kg/cm2)
Q (FLOW RATE, m3/day)

WELL PRESSURE TESTING METHOD

BACKGROUND OF THE INVENTION

This invention relates in general to the testing of a producing well, and in particular, relates to the testing of production capacity and quality to ensure the best possible performance of the well, and especially, to allow optimum drainage of the reservoir concerned.

Such tests, in accordance with prior art methods currently used, generally include the plotting of a flow-pressure graph which represents the inflow performance of the well. This graph is obtained by measuring the variations in the pressure of fluids at the bottom of the well over the producing zones when the total production flow is made to vary. In practice, the curve representing these variations is obtained from a small number of points. For example, two or three different production flows, including zero flow, are imposed successively and, for each of these flows measured at the surface, the corresponding pressure is measured at the bottom of the well at a level located over the producing zones.

Thus, the U.S. Pat. No. 2,348,192 (L. S. Chambers) proposes the downhole measurement of the pressure and the flow at several points of the interval covering the production zones. By combining the flow and pressure measurements, the technique described in the Chambers patent makes it possible to obtain performance curves by production zone, each curve indicating the variations in flow of each zone as a function of the variations in pressure at a selected depth of the well.

One of the difficulties of the Chambers technique lies in the pressure measurements, which must be very precise and taken at very precise depths. A pressure profile is difficult to obtain continuously along an interval of the well because of the usual defects of sensors which are generally subjected to temperature drifts or require significant time constants for the measurement. Consequently, the pressure measurements for which a good accuracy is required must be carried out in a stationary manner. The physical measurement of the pressure is not always possible at the desired level, for example at the top of effective production zones, the exact locations of which are not known before the logging operation. Moreover, it is difficult to come back exactly on several occasions to the same level when one wishes to carry out several successive pressure measurements at the same depth of the well.

It is the object of this invention to provide a well pressure profile in a precise manner, in particular where precise measurements for the testing of a production well are desired.

More generally, the object of the invention is to provide a method for testing a producing well making it possible to plot good performance curves per zone through the obtaining of adequate pressure data.

SUMMARY OF THE INVENTION

According to the invention, a well testing method for determining a representation of the pressures in a well at different selected levels of an interval including one or more production zones includes the following steps: carrying out pressure gradient measurements in the well along the interval of the wall; performing at least one stationary measurement of the local pressure of the well at a depth of this interval; and combining the pressure gradient measurements and at least one stationary local pressure measurement to determine the pressure profile of the well along the interval. In this combination step, the variations of the pressure gradient measurements are integrated along the interval to obtain a first pressure-variation profile; and the first profile is shifted until the best coincidence is obtained with the at least one stationary local pressure measurement to obtain the accurate pressure profile along the interval. The stationary local pressure measurement may be carried out in a zone of the well not located opposite the production zone and, generally, several stationary pressure measurements are carried out at random depths.

Preferably, when these first measurements have been carried out for determining the pressure profile of the well along the interval for a first total flow of the well, one also carries out, for this first total flow, second logging measurements to determine the flow of the fluids in the well along the interval. In this case, the method also includes the following operations: repeating the first and second measurements in the well for at least a second total flow of the well and combining the first and second measurements to determine a representation of the pressures in the well at a selected level corresponding to each effective production zone as a function of the flows in the corresponding production zone.

The different measurements can be performed by means of usual logging apparatus. The measurements for determining the flow of fluids in the well and the pressure gradient can be carried out by moving a logging sonde continuously along the well. On the other hand, usual logging apparatus used for pressure measurements often give imprecise measurements if they are moved along the borehole, owing to hysteresis phenomena and errors resulting from a delay in warming up. To obtain the pressure of the well along the interval, use is then made of the method of the invention in which one utilizes local pressure measurements combined with a pressure gradient measurement. Advantageously, the invention makes possible the determination of precise flow-pressure graphs for each production zone of a well interval from measurements from conventional logging apparatus.

For local pressure measurements, relatively imprecise results may be satisfactory when many values are obtained and combined with the integrated pressure gradient profile because these different local pressure measurements are then considered as a whole. After this combination, the correspondence between local pressures and local flowrates can be very precise, because the correspondence is established for the same levels taken from the same depth scale adjusted, for example, on the casing joints. It is moreover possible to advantageously select the depth levels for which the graphs are established on the basis of flow or pressure gradient measurements, thus making it possible to find an exact location, for example, just over a production zone or any other point deemed to be of greater interest for the interpretation of graphs and the study of the production of this zone.

BRIEF DESCRIPTION OF THE DRAWINGS

The novel features of the invention are set forth with particularity in the appended claims. The present invention, both as to its organization and operation, together with further objects and advantages thereof, may best be understood by reference to the following description taken in connection with the accompanying drawings in which:

DESCRIPTION OF THE INVENTION

Figure 1:
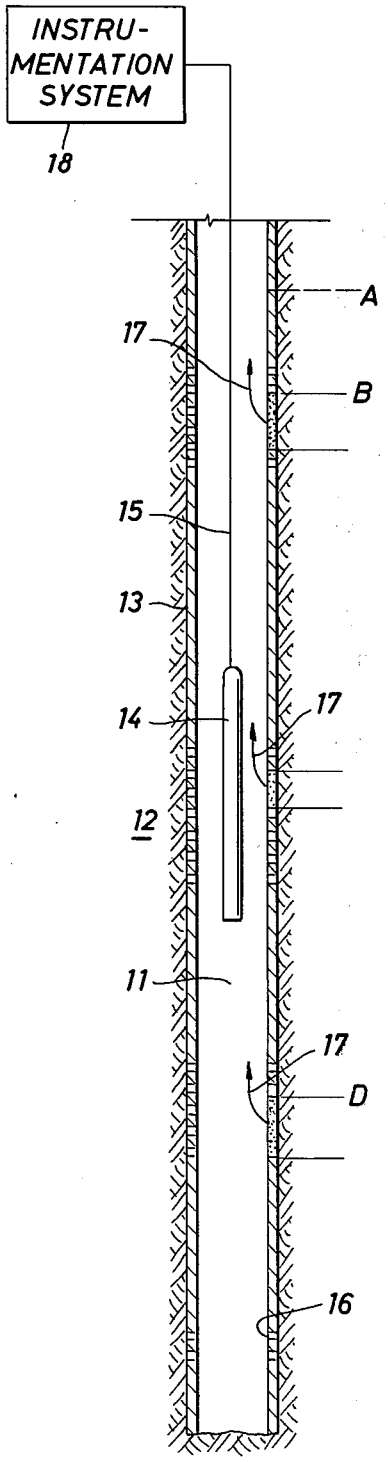
FIG. 1 schematically represents a well-testing installation in accordance with the invention.

In FIG. 1, a producing well 11 passes through formations 12 comprising several zones capable of producing hydrocarbons. The part of the well covering the producing formations may be left uncovered, without any lining, but more frequently, a casing 13 is placed against the well wall and includes several series of perforations 16 which establish communications between the producing formations and the inside of the well. These series of perforations comprise intervals through which the fluids of the formations flow into the well as shown by the arrows 17. These intervals define the effective production zones.

A well logging apparatus 14 is lowered into the well by means of a cable 15 which makes it possible, through a winch placed on the surface (not shown in the figure) to raise or lower the apparatus 14 as desired. The logging apparatus 14 comprises different measuring instruments which have not been shown in detail. The measurements carried out downhole by means of these instruments are converted into electrical signals which are transmitted via the cable 15 to a surface equipment 18 which supplies the well logging apparatus 14 and also receives and processes the measurement signals, if necessary up to the complete plotting of flow-pressure graphs representing the performance of the different production zones.

The downhole equipment 14 needed to make the necessary measurements for plotting the flow-pressure graphs comprises a casing collar locator, a flowmeter, a pressure-gradient measuring device and a pressure gauge.

A casing collar locator may be a conventional device of the magnetic flux variation type which generates a signal as it passes in front of a collar between two successive casing sections. These successive signals, recorded throughout the movement of the logging apparatus, provide a reference for the depth scale which is not influenced by cable elongation.

A flowmeter measures the rate of flow of fluids in the well and may be a screw-type flowmeter as described in U.S. Pat. No. 3,630,078 (J. L. Bonnet).

A pressure gradient measuring device, also used for measuring the average density of the fluids in the wall at each level, may be of the type described in U.S. Pat. No. 3,184,965 (S. P. Noik). Such a device delivers a signal which is a function, at the depth level at which it is located, of the difference between the pressures to which two membranes placed at a given distance from each other are subjected along the centerline of the well, in other words, in accordance with the pressure gradient. The signals delivered by this device, also known as a "gradiomanometer", are recorded on the surface in the form of pressure gradient values.

A pressure gauge which may be a simple Bourdon tube or another transducer delivering signals transmitted to the surface.

A usual sonde 14 also includes other measuring instruments and in particular a thermometer, the indications of which may be useful for specifying the nature of the fluids produced. These measuring instruments may be connected preferably to each other in order to form a single logging apparatus 14 lowered into the well in one operation. However, the instruments may also be used separately, each in association with a casing locator.

In the method according to the invention, logging measurements are carried out using the apparatus described above to determine the flowrate of the fluids and the pressure at selected levels of the well, and these measurements are repeated for several different levels of the total production flow. The total flow is modified by selecting combinations of several different openings at the well head. The curves of FIGS. 2, 3 and 4 were obtained for the same total flow, i.e., for a given opening at the well head. Modern logging apparatus makes it possible to carry out different measurements simultaneously. In older apparatus, measurements were made sequentially during successive passages along the interval of the well covering the production zones.

For a given total production flow, initial logging measurements are carried out to determine the flowrate of fluids in the well. Measurements of the rotating speed of the flowmeter screw are recorded as a function of depth. Several successive passages are generally carried out along the measurement interval and these measurements are processed in accordance with the method described in French Pat. No. 2,238,836 (Y. Nicolas) to obtain the flow Q at each level as represented by the curve 21 in FIG. 2. Beginning at the lowest level of the well, the production zones result in rapid increases in flow, up to the levels B, C and D respectively, while at depths intermediate between production zones, the flow remains constant. The production zones can thus be delimited, using the curve 21, by the parts of this curve representing flow increases. The flow of each production zone is immediately deduced from curve 21. For example, the flowrate of the fluids flowing in the lower production zone located immediately under the point D is provided by the difference Qi between the flowrates above and below this zone. Similarly, the flowrate of the upper production zone (below point B) is given by the value Qs.

Figure 2:
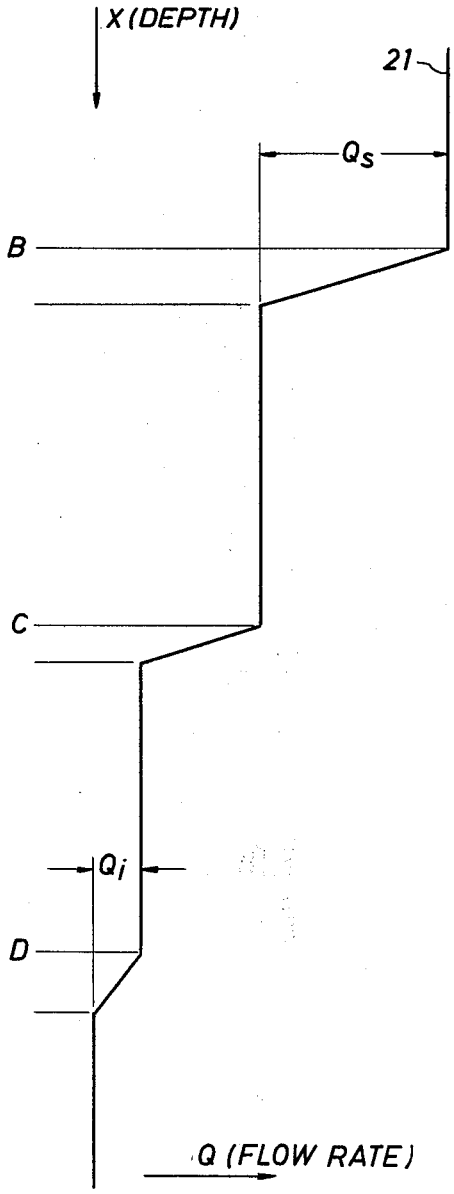
FIG. 2 is a graph showing the variations in flowrate as a function of depth which can be determined from first logging measurements.
Figure 3:
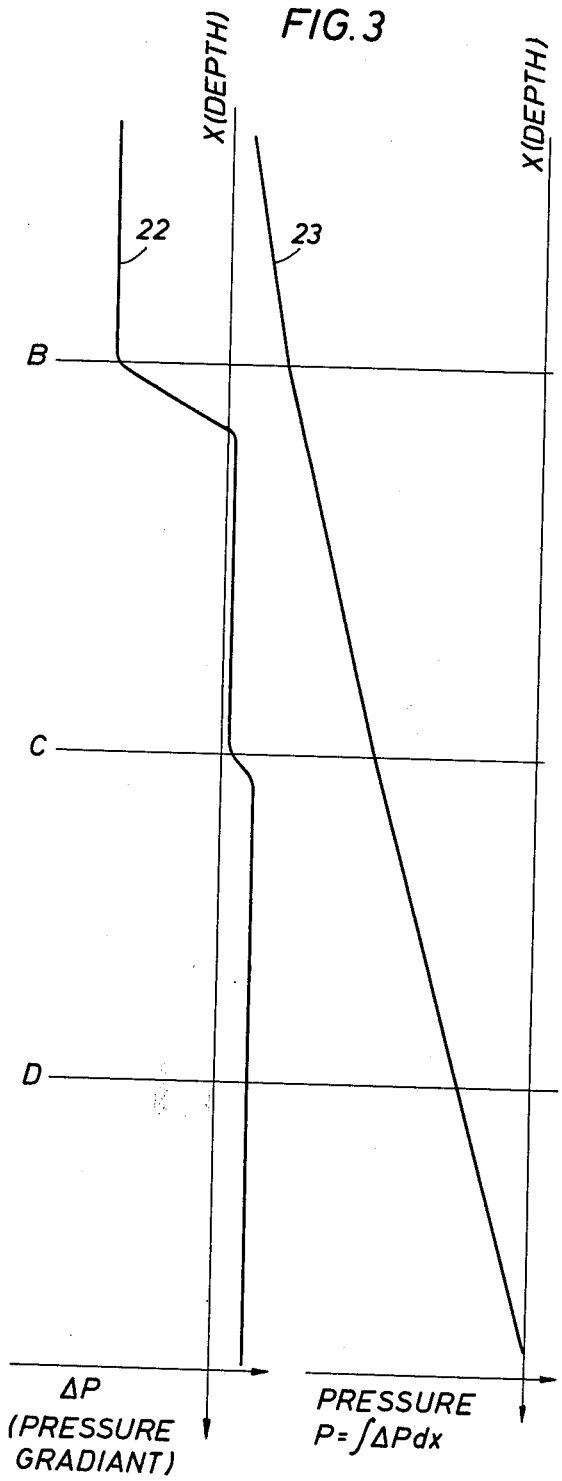
FIG. 3 shows a graph of pressure gradient variations as a function of well depth which can be determined by other logging measurements; a corresponding integrated profit of pressure is also shown.

For the same total flow, pressure gradient measurements are recorded as a function of depth, $P=f(x)$, and are illustrated for the well shown in FIG. 2 by curve 22 of FIG. 3. The shape of this curve may exhibit rapid variations in pressure gradient opposite certain production zones, when the average density inside the well is modified by the arrival of different fluids. Opposite the lower production zone (D), the fluids produced do not change the density of the fluid column in the well because they have the same density. By comparing with other measurements, for example pressure gradient measurements made in the well under no flow conditions which give the in situ density of the fluids separated by gravity, it is found that in the example, the lower zone (D) produces water, the middle zone (C) produces liquid hydrocarbons and the upper zone (B) produces a mixture of liquid and gas. Curve 22 may also be used to indicate certain production zones and often with better results than the flowrate curve.

Local pressure measurements are also carried out by means of the pressure gauge. A limited number of local values are recorded at different depth levels, each of the measurements being carried out with the sonde stationary in a part of the well in which the flow is not disturbed, i.e., not located opposite a production zone. These measurements are indicated by crosses (+) in FIG. 4 where the pressures are plotted on abscissa and the depths on the ordinate. As explained above, these pressure measurements and the depth measurements corresponding to the pressure measurement are generally not extremely precise. To obtain better results, pressure gradient measurements and local pressure measurements are combined to more accurately determine the pressure at each level of the well. By integrating the curve 22 of FIG. 3 of pressure gradient variations, curve 23 results which represents the profile of pressure variations as a function of depth. The measurement methods used to make it possible to obtain this profile with a high degree of accuracy but, on the pressure scale, the absolute value is not determined. By using the plotted pressure local values of FIG. 4, the pressure profile 23 from FIG. 3 is shifted until the best fit with the local values is obtained. The resulting curve 24 enables the determination of local pressure values precisely at well-defined selected depth levels as illustrated in FIG. 4 by dots (o) for the levels B, C and D.

As indicated above, the levels B, C and D are selected on the curve of flow variations in FIG. 2 to correspond to the points at which the flow becomes constant again as depth decreases, after a zone of rapid increase in flow. Levels B, C and D correspond to the upper levels of the effective production zones, which in general do not coincide with the upper perforation levels. The upper levels of the production zones can also be located for levels B and C on the pressure gradient curve of FIG. 3.

Figure 4:
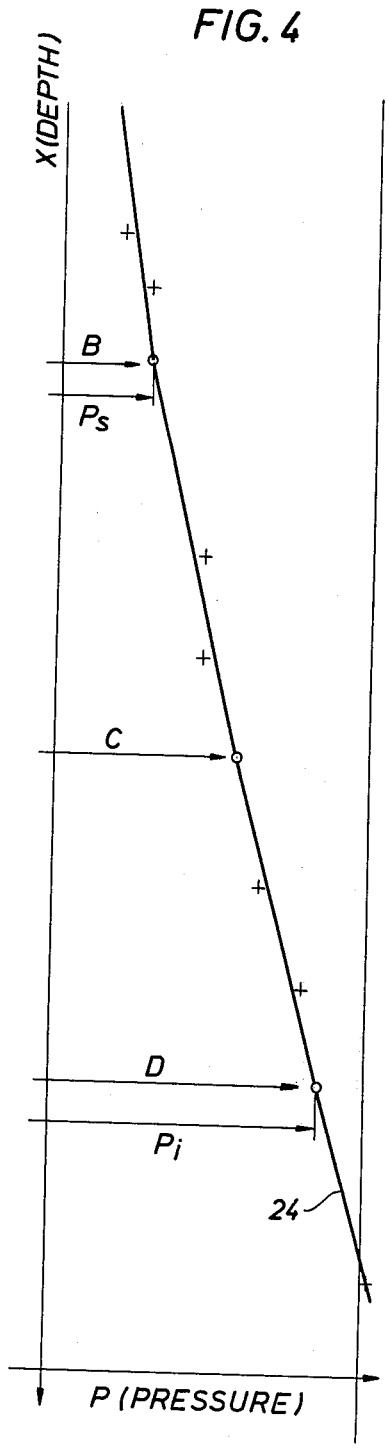
FIG. 4 illustrates a method for correcting the integrated gradient profile by local pressure measurements to determine the well pressures at all levels and in particular at selected levels B, C and D.

At each selected level B, C and D, the pressure corresponding to each production zone may be accurately determined from the curve of FIG. 4. For example, the pressure Pi at the level D which corresponds to the flow Qi of FIG. 2, and the pressure Ps at the level B corresponds to the flow Qs.

As indicated previously, the different measurement and processing operations just described are repeated for other flow conditions of the well by modifying the well head opening. It is generally sufficient to have two or three different values of the total production flow to which are added zero-flow pressure measurements. Of course, the upper levels B, C and D of the production zones, for which the flow and pressure values are determined, will remain the same.

Figure 5:
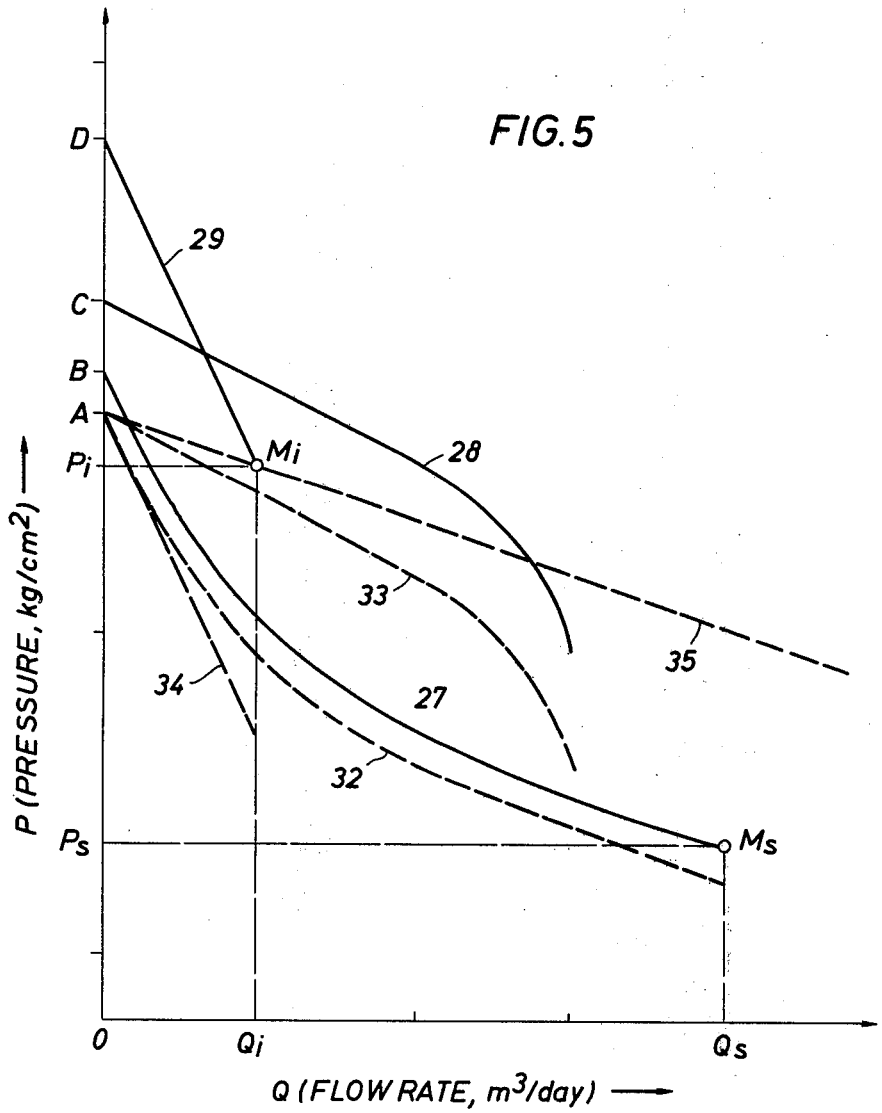
FIG. 5 illustrates flow-pressure graphs plotted for each production zone in the case of the installation of FIG. 1 from the curves of the preceding figures.

The different local pressure and flow values thus obtained are combined according to the invention in order to determine individually for each selected level a curve $P=f(Q)$ of performance flow-pressure. FIG. 5 shows the graphs thus obtained for the example well illustrated in FIG. 1.

For each total flow and for each production zone, a set of corresponding values (P, Q) is obtained, such as the sets (Pi, Qi) or (Ps, Qs). In the graph of FIG. 5 are plotted the points corresponding to these sets, with Q on the abscissa and P on the ordinate, as for example the points Mi and Ms corresponding to (Qi, Pi) and (Qs, Ps). Plotting of the P,Q sets for the lower production zone (level D) yields curve 29, the P,Q sets for the middle production zone (level C) yields curve 28 and the P,Q sets for the upper production zone (level B) yields curve 27.

Figure 6:
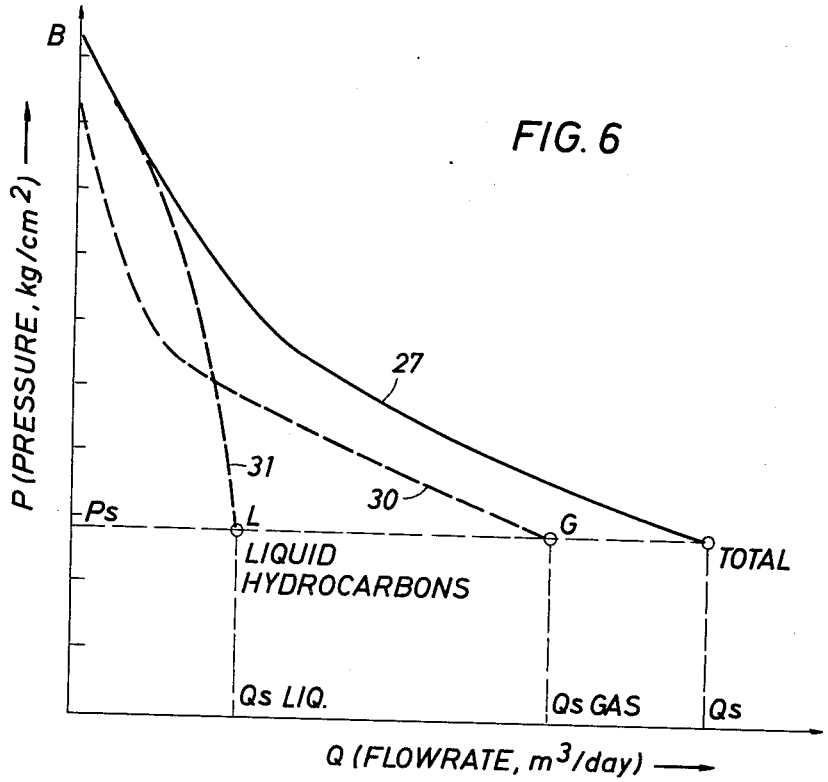
FIG. 6 represents a flow-pressure graph of each phase flowing in a particular production zone of the chosen example.

In the case of a two-phase flow zone, the method according to the invention may be extended. In the example, the fluids flowing in the upper production zone are made up of a mixture of liquid hydrocarbons and gas. The individual density of water, liquid hydrocarbons and gas may be determined by using, for example, the pressure gradient measurements carried out under zero flow conditions, i.e., with the well closed. U.S. Pat. No. 3,184,965 (Noïk) illustrates a pressure gradient instrument for determining the specific weights of the well bore fluid as a function of depth. As disclosed in the Noïk patent, the pressure difference measurement is indicative of the specific weight of the fluid. Next, the proportion of each phase under flow conditions flowing in the well is determined by means of the pressure gradient curve $\Delta P$ of FIG. 3. By combining the flow proportions of each phase and the flowrate obtained for the upper level of the zone, the flowrate of each phase flowing from the zone may be determined. Thus, as illustrated in FIG. 6, the flowgrate Qs is made up of a liquid hydrocarbon part, Qs liq and a gaseous part, Qs gas. It is possible to plot on a graph the point L having coordinates (Qs liq, Ps) and the point G having the coordinates (Qs gas, Ps) as shown in FIG. 6. Other flowrates are determined for each phase for the upper zone and the points having the corresponding pressures are plotted on the graph. By adding the points which correspond to gas flows, the curve 30 is obtained. Similarly, the curve 31 represents the flow variations of liquid hydrocarbons flowing in the upper zone as a function of pressure.

Figure 7:
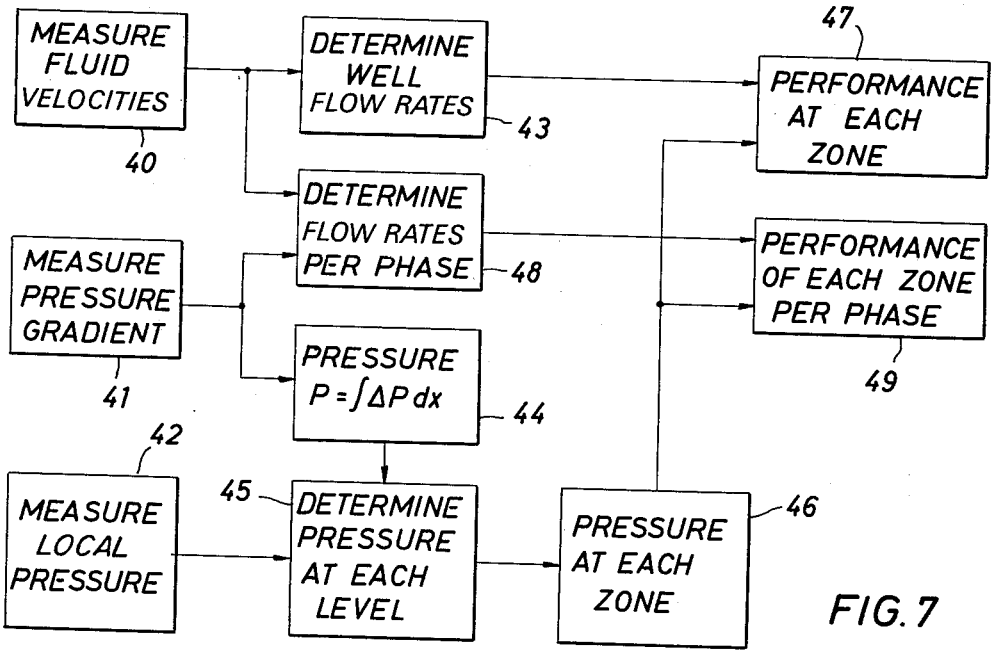
FIG. 7 is a block diagram showing the essential operations of the method according to the invention.

The different steps of the method are shown in the block diagram of FIG. 7. The blocks 40, 41 and 42 represent the measurements of fluid velocities, pressure gradient and local pressures carried out by means of the logging apparatus 14. The step 43 consists in determining the flows along the well by the method of U.S. Pat. No. 3,905,226 (Y. Nicolas) and deducing the flowrates, Q, of the production zones. To determine the pressures at the level of each production zone (block 46), the pressure gradient measurements (block 44) are integrated and the integrated curve is matched with the local pressure measurements (block 45). Finally (block 47), pressure P is determined as a function of Q for each production zone and the curves of FIG. 5 are plotted. The blocks 48 and 49 represent the additional steps necessary to obtain the curves for liquid and gas phases of the total flow as represented in FIG. 6.

The results thus obtained, represented by production zone, are of great interest. In the example described, these curves provide much more information than the total curve of well entry performance as obtained by conventional tests. Thus, for example, in the case of FIG. 5, pressure gradient measurements indicate that the lower production zone (level D) produces water and the curve 29 shows a linear relationship between pressure and flow. It is possible to deduce from this relationship for the entire production of the well that hydrcarbons are shifted upward in the reservoir, by the gradual advance of water caused by the decompression of a vast water reservoir or its permanent supply. For the production zone ending at the level C, the flow is made up of liquid hydrocarbons and the curve 28 of FIG. 5 exhibits a normal shape with a curvature which can be the indication of either turbulent flow or of a more marked skin effect toward higher flowrates. The curve 27 of the upper production zone (level B) indicates an abnormal evolution, of which the flow per phase is analyzed in the curves 30 and 31 of FIG. 6. The phase curves can indicate what type of abnormal situation is involved. The gas mixed with hydrocarbons which flows in the upper zone can either come from channeling along the outside of the casing or can gradually invade the oil zone through the effect of upward suction (gas-coning). An examination of the curves 30 and 31 clarifies the question because the acceleration of gas production associated with the slowing of liquid hydrocarbon production for the higher flowrates indicates, very probably, a suction phenomenon.

The curves 27, 28 and 29 are shifted in relation to each other on the pressure scale showing the differences which correspond to the static pressures existing at the respective levels. The curves can also be represented calibrated with respect to depth, i.e., shifted so as to begin at the same point of zero flow on the pressure axis. Such calibrated curves 32, 33 and 34 beginning at a point A and corresponding respectively to the curve 27, 28 and 29 are represented by dashed lines in FIG. 5. From curves 32, 33 and 34, it is possible to sum up the abscissas, i.e., the flows for similar ordinates, i.e., pressures, and thus create a curve 35 of the total performance of the well as it would be obtained by conventional tests. It will be noted here that curve 35 indicates the general performance of the well but does not give any of the detailed information provided by the individual curves per zone (32, 33 and 34).

Figure 8:
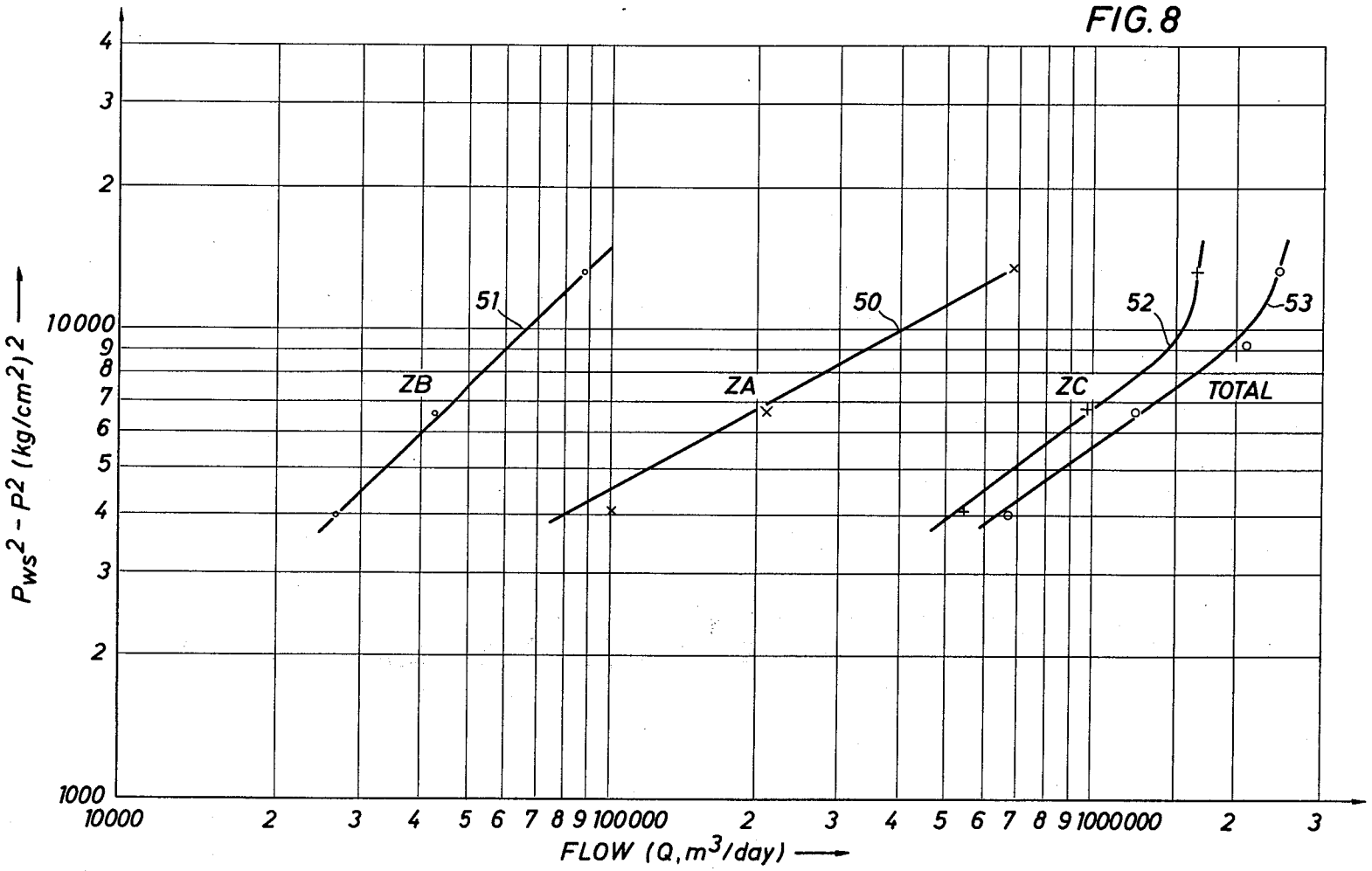
FIG. 8 is another flow-pressure graphic representation established for each production zone of a well.

FIG. 8 represents the performance curves per zone with a presentation different from that of FIG. 5. Instead of plotting on the ordinate axis the pressure P as in FIG. 5., the values ($Pws^2-P^2$) are plotted along the ordinate. For each zone, Pws is the pressure obtained at the upper level of this zone on a profile of pressures of the type of that in FIG. 4 plotted for a zero flow, i.e., with the well closed. The curves of FIG. 8 are plotted with logarithmic scales on the axes of abscissas as well as ordinates. This representation is taken from the empirical formula proposed by Schellardt and Rawlins for the gas producing wells:

$$Q=C\,(Pws^2-Pwf^2)^n$$

and extended to the oil producing wells by M. J. Fetkovich as formula:

$$Q=J'(Pws^2-Pwf^2)^n$$

In fact, if one adopts this formula, the representation of FIG. 8 should give, as a performance curve, the lines whose slope depends on the coefficient n representative of the production possibilities of the zone and whose relative position along the abscissa depends on the coefficient J' representative of the absolute performance of the zone. This presentation is thus of great value since it gives the specialist in a single glance a large amount of information.

In FIG. 8, three performance curves 50, 51, 52 correspond respectively to three gas production zones ZA, ZB and ZC and a fourth performance curve 53 corresponds to the total production of the three zones. The position of the curves 50 and 51 far to the left of the curves 52 and 53 shows the small participation of the zones ZA and ZB in the total production (low J' coefficients for curves 50 and 51). Another interesting detail which appears clearly is the sudden reduction in the productivity index related to n (i.e., a sudden increase in the slope of the curves 52 and 53) for flows higher than a certain threshold.

The different steps of the method according to the invention have been set forth above with reference to curves for the sake of clarity. It should however be understood that all the operations can be carried out using any suitable automatic means and electronic circuits, known in themselves, whether for the control of the measurement sequences or the reception and processing of signals and recordings, including the integration of presssure gradient variations, the search for the best matching with the locally measured pressures and the plotting of the curves of the flow-pressure graph. In general, an analog or digital type computer would be useful.

Numerous other variations and modifications may obviously be made without departing from the invention. Accordingly, it should be clearly understood that the forms of the invention described above as shown in the figures of the accompanying drawings are illustrative only and are not intended to limit the scope of the invention as defined by the claims which follow.

What is claimed is:

1. A well test method for determining a represenation of the pressures in a well at different selected levels of an interval having one or more production zones, comprising the following steps:

making pressure gradient measurements in the well along the interval of the well;

making at least one stationary meaurement of the local pressure in the well at a depth in the interval; and combining the pressure gradient measurements and the said at least one stationary local pressure measurement by integrating the variations of the pressure gradient measurements along the interval to obtain a first pressure-variation profile and shifting the first profile until the best coincidence is obtained with the at least one stationary local pressure measurement to determine the pressure profile of the well along the interval.

2. The method of claim 1 wherein the stationary local pressure measurement is carried out in a zone of the interval of the well not located opposite a production zone.

3. The method of claim 1 further comprising the step of delineating the effective production zones of the well according to the shape of a pressure gradient measurement curve.

4. The well test method of determining pressure as a function of flowrate for each production zone in an interval of the well, comprising the steps:

(1) For a first total flow of the well, (a) making pressure gradient measurements in the well along the interval of the well;

(b) making at least one stationary measurement of the local pressure in the well at a depth in the interval;

(c) combining the pressure gradient measurements and said at least one stationary local pressure measurement to determine the pressure profile of the well along the interval;

(d) making a logging measurement of the well flow in the well along the interval;

(2) For at least a second total flow of the well, repeating steps (a), (b), (c) and (d) above; and (3) For a selected level corresponding to each production level in the well, combining the pressure profile and measured well flow data determined for the first total flow of the well with the pressure profile and measured well flow data determined for the second total flow of the well to determine for each production level a representation of the pressure as a function of the flow from the production level.

5. The method of claim 4 wherein logging measurements for determining the flow of fluids in the well include the operation of measuring the rotating speed of a screw-type detector moved along the interval.

6. The method of claim 4 further comprising the step of delineating the effective production zones of the well according to the shape of the pressure versus flow curve from a selected level corresponding to a production level to determine the identity of fluids in each production zone of the well.

7. The method of claim 6 wherein each of said selected levels is determined at the upper end of an effective production zone.

8. The method of claim 4 further comprising the steps of:

combining the well flow logging measurements and the pressure gradient masurements to determine the flows of each phase from at least one biphase production zone; and combining the flows of each phase and the integrated pressure gradient and stationary pressure logging measurements to determine a representation of the pressures in the well as a function of the flows of each phase from the biphase production zone.

9. The method of claim 4 further comprising the step of plotting a curve corresponding to each representation of pressure as a function of the flow from a production zone.

* * * * *